US008553054B2

(12) United States Patent
Yasumatsu

(10) Patent No.: US 8,553,054 B2
(45) Date of Patent: Oct. 8, 2013

(54) THERMAL-TRANSFER LAMINATE FILM, THERMAL-TRANSFER SHEET, AND IMAGE FORMING APPARATUS

(75) Inventor: Ryo Yasumatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 28 days.

(21) Appl. No.: 13/416,476

(22) Filed: Mar. 9, 2012

(65) Prior Publication Data

US 2012/0242773 A1 Sep. 27, 2012

(30) Foreign Application Priority Data

Mar. 25, 2011 (JP) ..... 2011-068387

(51) Int. Cl.
*B41J 2/325* (2006.01)

(52) U.S. Cl.
USPC ..... 347/176; 347/217

(58) Field of Classification Search
USPC ..... 347/171, 172, 174, 176, 217, 221; 428/32.6
See application file for complete search history.

(56) References Cited

U.S. PATENT DOCUMENTS

| | | | | |
|---|---|---|---|---|
| 7,864,206 | B2 * | 1/2011 | Yasumatsu | 347/217 |
| 2009/0303307 | A1 * | 12/2009 | Yasumatsu | 347/221 |
| 2012/0225775 | A1 * | 9/2012 | Yasumatsu | 503/227 |

FOREIGN PATENT DOCUMENTS

| | | |
|---|---|---|
| JP | 58-147390 | 9/1983 |
| JP | 60-23096 | 2/1985 |
| JP | 60-204397 | 10/1985 |
| JP | 2000-108526 | 4/2000 |

* cited by examiner

*Primary Examiner* — Huan Tran
(74) *Attorney, Agent, or Firm* — Frommer Lawrence & Haug LLP; William S. Frommer

(57) ABSTRACT

A thermal-transfer laminate film includes a base film, an untransferring release layer, and an image protection layer. The untransferring release layer is provided on the base film and includes a first thermoplastic resin having a first I/O value. The image protection layer is provided on the untransferring release layer and includes a second thermoplastic resin having a second I/O value, an absolute value of a difference between the first I/O value and the second I/O value being larger than 0.40.

5 Claims, 3 Drawing Sheets

THERMAL-TRANSFER LAMINATE FILM, THERMAL-TRANSFER SHEET, AND IMAGE FORMING APPARATUS

BACKGROUND

The present disclosure relates to a thermal-transfer laminate film, a thermal-transfer sheet, and an image forming apparatus including the thermal-transfer laminate film and the thermal-transfer sheet.

From the past, for image protection, a thermal-transfer image protection layer formed of a thermoplastic resin has been laminated on an image formed on a printing paper, that is, an image formed by, for example, a sublimation-type thermal-transfer method that uses a sublimation dye or a thermal diffusion dye.

As a lamination method of a thermal-transfer image protection layer, a method of performing thermocompression bonding on an ink image using a heating roller is known. There is also known a method of structuring an image laminate film including a base film and a thermal-transfer image protection layer that is formed of a thermoplastic resin and formed on the base film and transferring only the heated part of the thermal-transfer image protection layer onto an image using a thermal head or the like, that is, a method that uses a thermal-transfer laminate film (see, for example, Japanese Patent Application Laid-open No. Sho 58-147390, Japanese Patent Application Laid-open No. Sho 60-23096, and Japanese Patent Application Laid-open No. Sho 60-204397).

By laminating the thermal-transfer image protection layer on a formed image as described above, an improvement of an image preservation stability can be expected, for example.

In addition, an untransferring release layer may be interposed between the base film and the image protection layer. The untransferring release layer is provided for enhancing a detachability of the base film and the image protection layer during thermal transfer. In other words, when the image protection layer is thermally transferred onto an ink image using a thermal energy of the thermal head, the adjacent image protection layer is positively peeled off at an interface between the image protection layer and the untransferring release layer so as to transfer only the image protection layer onto a printing paper.

For example, in Japanese Patent Application Laid-open No. 2000-108526, an ionomer of a fluorine-modified acrylic resin is used on an untransferring release layer to enhance adhesiveness between the untransferring release layer and a base film and obtain a favorable detachability of an image protection layer.

SUMMARY

In view of the circumstances as described above, there is a need for a thermal-transfer laminate film, a thermal-transfer sheet, and an image forming apparatus in which an untransferring release layer and an image protection layer can be easily peeled off from each other and with which stable thermal transfer can be performed.

According to an embodiment of the present disclosure, there is provided a thermal-transfer laminate film including a base film, an untransferring release layer, and an image protection layer.

The untransferring release layer is provided on the base film and includes a first thermoplastic resin having a first I/O value.

The image protection layer is provided on the untransferring release layer and includes a second thermoplastic resin having a second I/O value, an absolute value of a difference between the first I/O value and the second I/O value being larger than 0.40.

In the thermal-transfer laminate film, the image protection layer can be easily peeled off from the thermal-transfer laminate film when forming an image by a thermal-transfer method. As a result, the image protection layer is transferred onto a formed image, and an image preservation property can be improved, for example.

The thermal-transfer laminate film may further include an adhesive layer provided on the image protection layer.

With this structure, when peeling off the image protection layer, the image protection layer can be made to adhere onto the to-be-recorded medium with ease.

The absolute value of the difference between the first I/O value and the second I/O value may be smaller than 0.75. Since there is moderate adhesiveness between the untransferring release layer and the image protection layer in such a thermal-transfer laminate film, the thermal-transfer laminate film has excellent handleability.

According to an embodiment of the present disclosure, there is provided a thermal-transfer sheet including a base film, an untransferring release layer, an image protection layer, and an ink layer.

The untransferring release layer is provided on the base film and includes a first thermoplastic resin having a first I/O value.

The image protection layer is provided on the untransferring release layer and includes a second thermoplastic resin having a second I/O value, an absolute value of a difference between the first I/O value and the second I/O value being larger than 0.40 and smaller than 0.75.

The ink layer is provided on the base film.

According to an embodiment of the present disclosure, there is provided an image forming apparatus including a conveyor mechanism, a thermal-transfer sheet, a travel mechanism, and a thermal-transfer head.

The conveyor mechanism is configured to convey a to-be-recorded medium in a predetermined direction.

The thermal-transfer sheet includes an untransferring release layer that includes a first thermoplastic resin having a first I/O value, an image protection layer that includes a second thermoplastic resin having a second I/O value, an absolute value of a difference between the first I/O value and the second I/O value being larger than 0.40 and smaller than 0.75, and an ink layer that is thermally transferred onto a surface of the to-be-recorded medium to form an image.

The travel mechanism is configured to cause the thermal-transfer sheet to travel.

The thermal-transfer head is configured to cause one of the ink layer and the image protection layer of the thermal-transfer sheet to be thermally transferred onto the surface of the to-be-recorded medium.

As described above, according to the embodiments of the present disclosure, in forming an image by the thermal-transfer method, the image protection layer and the untransferring release layer can be easily peeled off from each other.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, embodiments of the present disclosure will be described with reference to the drawings.

<First Embodiment>

Figure 1:
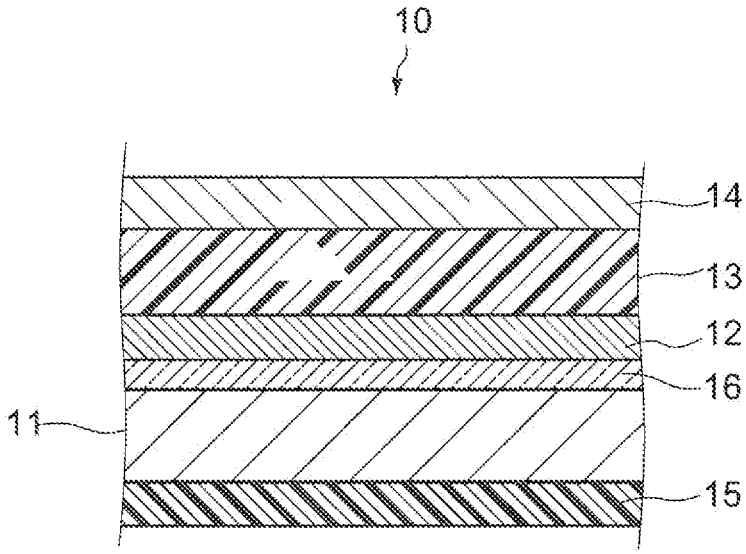
FIG. 1 is a partial cross-sectional diagram showing a structure of a thermal-transfer laminate film according to a first embodiment of the present disclosure.

FIG. 1 is a schematic cross-sectional diagram showing a structural example of a thermal-transfer laminate film according to an embodiment of the present disclosure.

The thermal-transfer laminate film 10 includes a base film 11, an untransferring release layer 12, and an image protection layer 13. A primer layer 16 is interposed between the base film 11 and the untransferring release layer 12, and an adhesive layer 14 is formed on the image protection layer 13. Specifically, the primer layer 16, the untransferring release layer 12, the image protection layer 13, and the adhesive layer 14 are laminated in the stated order on the base film 11. Further, on a surface of the base film 11 on the other side of the surface on which the layers are formed, a heat resistant slipping layer 15 is formed. It should be noted that the primer layer 16, the adhesive layer 14, and the heat resistant slipping layer 15 may be omitted as necessary.

(Base Film)

The base film 11 is constituted of, for example, a transparent plastic film. The base film 11 is not particularly limited and is constituted of a general-purpose plastic film such as a polyester film, a polyethylene film, and a polypropylene film and a super engineering plastic film such as a polyimide film. The materials as described above are capable of holding the laminated layers and have a sufficient resistance with respect to heat applied during thermal transfer. Further, an extension processing method such as a biaxial extension and a longitudinal extension is typically adopted as a method of forming the base film 11, and a thickness is not particularly limited as long as it has sufficient heat resistance, mechanical strength, and the like.

(Primer Layer)

The primer layer 16 is formed on the surface of the base film 11. The primer layer 16 is formed of, for example, an urethane-based resin, an acrylic resin, or a polyester-based resin, though not particularly limited thereto. The material of the primer layer 16 can be selected as appropriate based on the types of resin used for the base film 11 and the untransferring release layer 12. It should be noted that since the primer layer 16 is for enhancing adhesiveness between the base film 11 and the untransferring release layer 12, the primer layer 16 may be omitted when there is sufficient adhesiveness between the base film 11 and the untransferring release layer 12.

Typically, the primer layer 16 is formed with a thickness of several μm before the extension processing of the base film 11. After that, by subjecting the base film 11 to, for example, biaxial extension processing, a primer layer 16 having a uniform thickness can be formed. The thickness of the primer layer 16 is not particularly limited and only needs to be uniform while being 1 μm or less, for example.

(Untransferring Release Layer)

The untransferring release layer 12 is formed on the primer layer 16. The untransferring release layer 12 is formed of a thermoplastic resin (first thermoplastic resin) such as a polyvinyl acetoacetal resin, a polyvinyl butyral resin, a copolymer of those, a polyvinyl alcohol resin, an acrylic resin, a polyester resin, a polyamide resin, a polyamide imide resin, a polyether sulfone resin, a polyether ether ketone resin, a polysulfone resin, and a cellulose derivative.

The first thermoplastic resin shows a first I/O value. An I/O value shown by a thermoplastic resin is specifically described in "Essentials of Organic Conceptual Diagram" (Yoshio Koda, SANKYO PUBLISHING Co., Ltd., 1984) and the like. The I/O value shown by a thermoplastic resin is calculated by classifying a property of a functional group of a monomer into an inorganic degree (I value) representing an ion bonding property and an organic degree (O value) representing a covalent bonding property based on a molecular structure of a monomer constituting a thermoplastic resin and taking a ratio of those values.

The inorganic degree (I value) is a value obtained by digitalizing a size of an influence of various substituent groups or bonds of an organic compound on a boiling point based on a hydroxyl group. Specifically, since the boiling point becomes about 100° when a distance between a boiling point curve of a linear alcohol and that of a linear paraffin is taken around a carbon number 5, a value obtained by digitalizing, while determining an influence of a single hydroxyl group as 100, a size of an influence of various substituent groups or bonds on a boiling point based on such a numerical value becomes the inorganic degree (I value) of a substituent group including an organic compound. For example, the inorganic degree of a -COOH group is 150, and the inorganic degree of a double bond is 2. Therefore, the I value that a certain type of organic compound shows refers to a sum of inorganic degrees (I values) of various substituent groups and bonds in the compound.

Further, with a methylene group in a molecule being a unit, the organic degree (O value) is determined based on a size of an influence of a carbon atom representing the methylene group on a boiling point. Specifically, since a mean value of a raise in boiling points due to an addition of a single carbon in the vicinity of carbon numbers 5 to 10 in a linear saturated hydrocarbon compound is 20° C., the organic degree (O value) of a single carbon atom is determined as 20, and a value obtained by digitalizing a size of an influence of various substituent groups or bonds on a boiling point based on such a numerical value becomes the organic degree (O value). For example, the organic degree (O value) of a nitro group (-NO2) is 70. As the I/O value becomes smaller, a compound has a smaller polarity (higher hydrophobicity and organic nature), and as the I/O value becomes larger, a compound has a larger polarity (higher hydrophilicity and inorganic nature).

As a method of forming the untransferring release layer 12, there are various methods such as gravure coating, gravure reverse coating, and roll coating for applying a coating fluid including the resin described above and drying it. Moreover, the thickness of the untransferring release layer 12 is not particularly limited, and with a dried thickness of, for example, 1.0 μm, a sufficient heat resistance can be obtained and a function of the untransferring release layer 12 is also not impaired.

(Image Protection Layer)

The image protection layer 13 is formed on the surface of the untransferring release layer 12 and is peeled off from the untransferring release layer 12 when an image is formed by a thermal-transfer method to be transferred onto a formed image. The image protection layer 13 is formed of a thermoplastic resin (second thermoplastic resin) such as a polystyrene resin, an acrylic resin, and a polyester resin.

The second thermoplastic resin is not particularly limited as long as it shows a second I/O value with which an absolute value of a difference with the first I/O value is larger than 0.40. As the difference between the first I/O value and the second I/O value increases, an affinity between the untransferring release layer 12 and the image protection layer 13 becomes lower, with the result that peeling among those layers becomes easy. Accordingly, the untransferring release layer 12 and the image protection layer 13 have an excellent detachability at a time of thermal transfer, and the image protection layer can be thermally transferred without imparting a quality of a surface of a formed image.

Furthermore, in this embodiment, the first and second thermoplastic resins are selected so that the absolute value of a difference between the first I/O value and the second I/O value becomes smaller than 0.75. With such a combination of the thermoplastic resins, even when an external force is applied to a top surface of the thermal-transfer laminate film 10, the image protection layer 13 can be easily peeled off from the untransferring release layer 12, with the result that inconveniences in terms of hanleability can be prevented from occurring.

Further, the image protection layer 13 may contain an ultraviolet absorber. Examples of a usable ultraviolet absorber include a salicylic acid derivative, a benzophenone derivative, a benzotriazole derivative, and an oxalic anilide derivative. Accordingly, a light resistance can be improved.

The image protection layer 13 is thermally transferred onto a formed image so as to improve, for example, an image preservation property. In addition, depending on the second thermoplastic resin, various functions such as a gas resistance, light fastness, a resistance to plasticizers, an abrasion resistance, a sebum resistance, an impartation of a writing/stamping property, an impartation of a matte taste to a surface of a printed object, and the like can be imparted to a formed image. Further, a desired surface shape such as a matte surface can be formed by nonuniformly varying an energy during thermal transfer.

As a method of forming the image protection layer 13, there are various methods such as gravure coating, gravure reverse coating, and roll coating for applying a coating fluid including the resin and drying it. Moreover, in this technique, the thickness of the image protection layer 13 is not particularly limited, and with a dried thickness of, for example, 1.0 μm, a sufficient heat resistance can be obtained and a function of the image protection layer 13 is also not impaired.

(Adhesive Layer)

The adhesive layer 14 is formed on the surface of the image protection layer 13. The adhesive layer 14 is formed of a thermoplastic resin such as a polyester-based resin, an acrylic resin, a cellulose-based resin, a vinyl chloride-vinyl acetate copolymer, a urethane-based resin, and an ethylene-vinyl acetate copolymer and is not particularly limited as long as it can easily bond the image protection layer 13 to a to-be-recorded medium side.

As a method of forming the adhesive layer 14 on the image protection layer 13, there are various methods such as gravure coating, gravure reverse coating, and roll coating for applying a coating fluid including the resin described above and drying it. Moreover, the thickness of the adhesive layer 14 is not particularly limited and can be arbitrarily set, so that a coating thickness falls within the range of 0.1 to 10 μm.

(Heat Resistant Slipping Layer)

The heat resistant slipping layer 15 is formed on the back surface of the base film 11. The heat resistant slipping layer 15 is provided for enabling a thermal-transfer head (not shown) and the base film 11 to travel without sticking or fusing with respect to each other. It should be noted that the heat resistant slipping layer 15 does not need to be provided in particular when a heat resistance and slip property of the base film 11 are favorable. The material for forming the heat resistant slipping layer 15 is not particularly limited as long as it has a high heat resistance and can keep a friction coefficient between the thermal-transfer head almost constant during heating and even when not heated. Examples of the material include acetylcellulose, a polyvinyl acetoacetal resin, and a polyvinyl butyral resin.

In the thermal-transfer laminate film 10 of this embodiment having the structure as described above, an absolute value of a difference between the I/O values of the thermoplastic resins forming the untransferring release layer 12 and the image protection layer 13 is larger than 0.40. Therefore, in forming an image by thermal transfer, the image protection layer 13 can be easily peeled off from the untransferring release layer 12. In addition, when the absolute value of a difference between the I/O values is smaller than 0.75, a sufficient resistance to an external force can be imparted to the image protection layer 13, with the result that a handleability can be improved.

<Second Embodiment>

The thermal-transfer laminate film structured as described above can be used in a thermal-transfer sheet such as an ink ribbon. Hereinafter, a thermal-transfer sheet having the structure of the thermal-transfer laminate film 10 will be described.

[Thermal-Transfer Sheet]

Figure 2A:
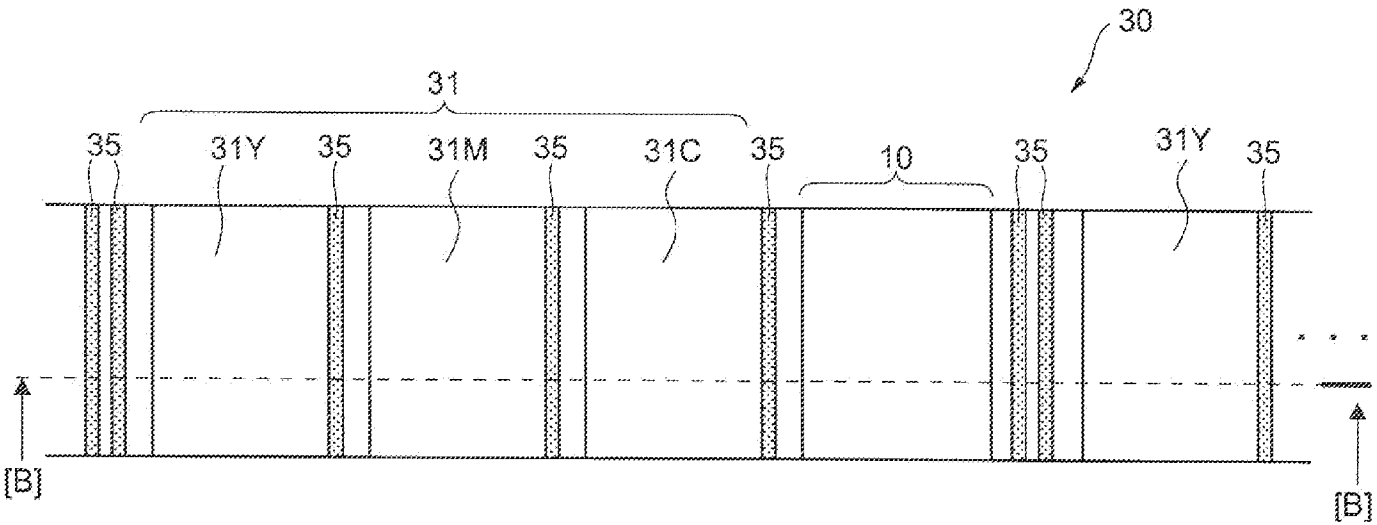
FIG. 2 are diagrams showing a structure of a thermal-transfer sheet according to an embodiment of the present disclosure, FIG. 2A being a plan view and FIG. 2B being a cross-sectional diagram taken along the line <B>-<B> of FIG. 2A.
Figure 2B:
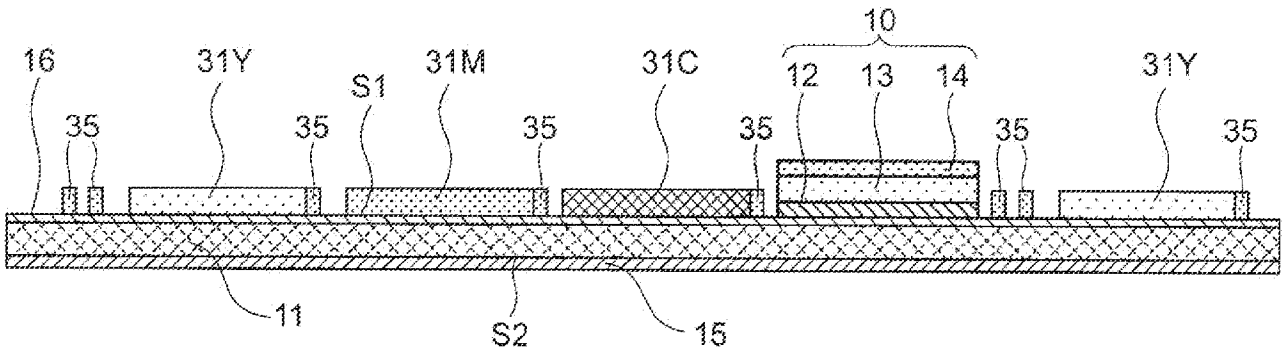

FIG. 2 are schematic diagrams showing the thermal-transfer sheet according to the embodiment of the present disclosure, FIG. 2A being a plan view and FIG. 2B being a cross-sectional diagram taken along the line <B>- <B> of FIG. 2A. The thermal-transfer sheet 30 includes the base film 11, the untransferring release layer 12 formed on the base film 11, the image protection layer 13, and ink layers 31.

On a first surface S1 side of the base film 11 in the thermal-transfer sheet 30, yellow (Y), magenta (M), and cyan (C) ink layers 31 (31Y, 31M, 31C) are formed along a conveyance direction of the thermal-transfer sheet 30 via the primer layer 16. Also on the first surface S1 side of the base film 11, the untransferring release layer 12, the image protection layer 13, and the adhesive layer 14 are formed via the primer layer 16. On a back surface (second surface S2) side of the base film 11, the heat resistant slipping layer 15 is formed for lowering a friction between a thermal-transfer head and an ink ribbon and enabling the thermal-transfer sheet 30 to travel stably. It should be noted that the untransferring release layer 12, the image protection layer 13, and the adhesive layer 14 and parts of the base film 11, the primer layer 16, and the heat resistant slipping layer 15 on which the layers above are provided form the thermal-transfer laminate film 10 described above with reference to FIG. 1.

It should be noted that the primer layer 16 does not need to be provided in a case where the base film 11 and the untransferring release layer 12 have sufficient adhesiveness. In addition, the adhesive layer 14 does not need to be provided in a case where the image protection layer 13 can be easily transferred onto a formed image. Furthermore, the heat resistant slipping layer 15 does not need to be provided in a case where a heat resistance and slip property of the base film 11 are favorable.

The ink layers 31 (31Y, 31M, 31C) and the thermal-transfer laminate film 10 are formed cyclically in order, and the thermal-transfer laminate film 10 is provided subsequent to the ink layers 31 (31Y, 31M, 31C). Moreover, in the thermal-transfer sheet 30, sensor marks 35 are formed at end portions of the ink layers 31 (31Y, 31M, 31C) and in the vicinity of the thermal-transfer laminate film 10.

The ink layers 31 (31Y, 31M, 31C) are typically formed of a sublimation dye. Further, as a binder resin, a cellulose-based resin such as methyl cellulose, ethyl cellulose, ethyl hydroxyethyl cellulose, hydroxypropyl cellulose, butyric acetate cellulose, and acetate cellulose, a vinyl-based resin such as polyvinyl alcohol, polyvinyl butyral, polyvinyl acetoacetal, polyvinyl acetate, and polystyrene, a polyester-based resin, an acrylic resin, a urethane-based resin, or various other resins may be included.

Pigment dyes of the ink layers 31 (31Y, 31M, 31C) are dispersed or dissolved in the binder resin. The material of the pigment dye is not particularly limited, and specific materials are as follows. Specifically, as a yellow dye, for example, an azoic dye, a disazoic dye, a methine-based dye, a styryl-based dye, a pyridone-azoic dye, or a mixture of those is used. As a magenta dye, for example, an azoic dye, an anthraquinone-based dye, a styryl-based dye, a heterocycle azoic dye, or a mixture of those is used. As a cyan dye, for example, an anthraquinone-based dye, a naphthoquinone-based dye, a heterocycle azoic dye, an indoaniline-based dye, or a mixture of those is used. It should be noted that a mixture of a plurality of types of dyes is often used as the pigment dyes.

Typically, a dye having a thermal transitivity to cause a thermal diffusion from inside the ink layers 31 in a pigment dye molecule unit is used as the pigment dyes. The characteristics required for the pigment dyes are that, for example, a thermal decomposition is not caused within a thermal energy range of the thermal-transfer head, syntheses are simple, an image preservation property is excellent (stable with respect to heat, light, temperature, and drug), an absorption wavelength range is favorable, and recrystallization is hard to be caused in the ink layers 31.

When performing thermal-transfer printing by an image forming apparatus (e.g., thermal-transfer printer) using the thermal-transfer sheet 30, a desired image can be obtained by thermally transferring the image protection layer 13 and adhesive layer 14 part of the thermal-transfer laminate film 10 onto an ink image by a thermal-transfer head of the printer. In other words, after an image is formed by thermally transferring the ink layers 31 of the thermal-transfer sheet 30, peeling occurs at the boundary between the untransferring release layer 12 and the image protection layer 13 in the thermal-transfer laminate film 10 formed in a part of the thermal-transfer sheet 30, and the image protection layer 13 and the adhesive layer 14 formed thereon are thermally transferred onto the ink image.

In the thermal-transfer sheet 30 of this embodiment, an absolute value of a difference between the I/O values of the thermoplastic resins forming the untransferring release layer 12 and the image protection layer 13 is larger than 0.40 and smaller than 0.75. Therefore, in forming an image by thermal transfer, the image protection layer 13 can be easily peeled off from the untransferring release layer 12. In addition, a sufficient resistance to an external force can be imparted so that, for example, the image protection layer 13 can be easily peeled off even when the surface of the thermal-transfer laminate film is, accidentally scratched by a fingernail when handling the ink ribbon, and inconveniences in terms of handleability can be prevented from occurring.

<Third Embodiment>

The thermal-transfer sheet 30 structured as described above can be used in an image forming apparatus such as a printer.

[Image Forming Apparatus]

Figure 3:
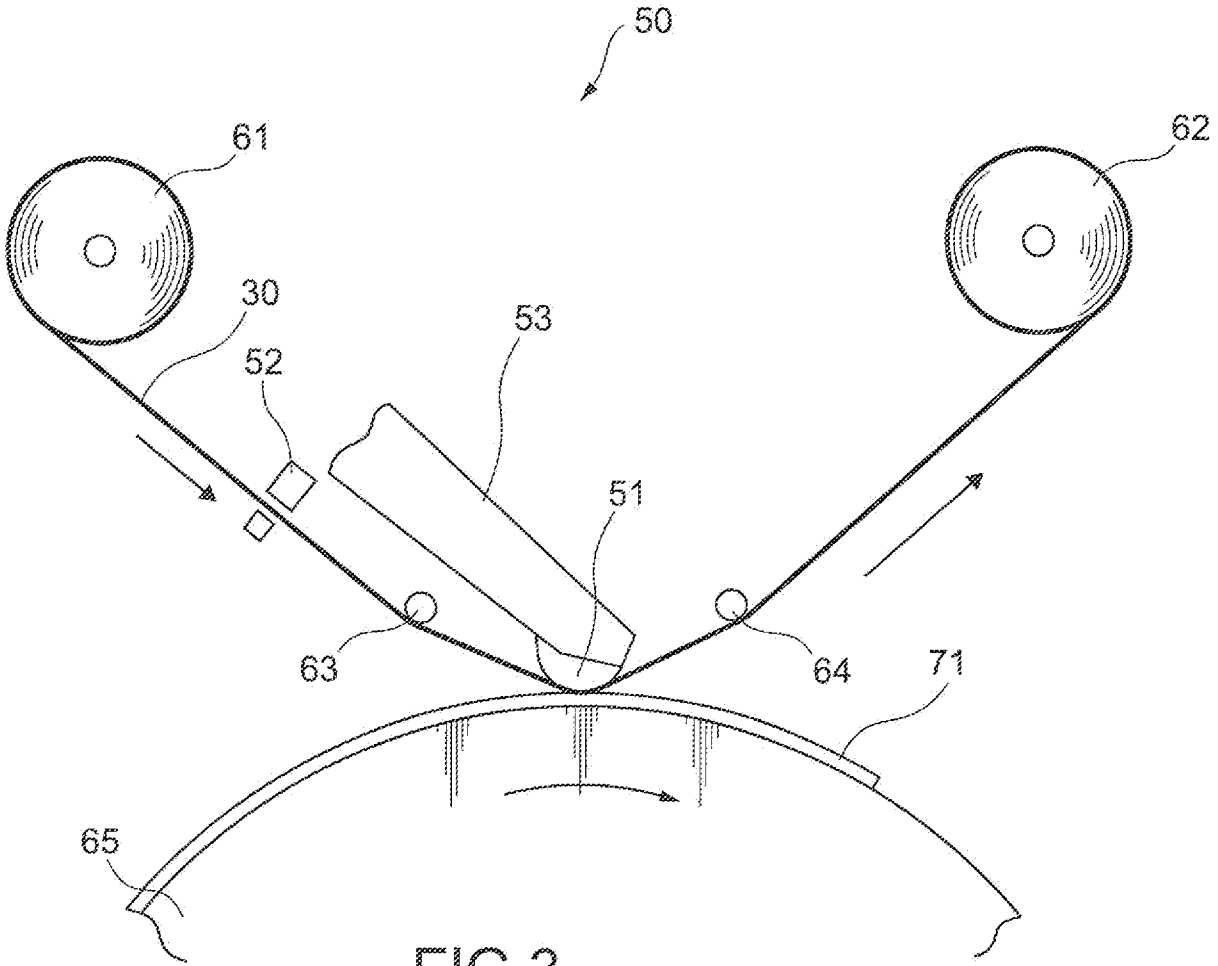
FIG. 3 is a schematic structural diagram showing a main portion of an image forming apparatus according to an embodiment of the present disclosure.

FIG. 3 is a schematic structural diagram showing a main portion of an image forming apparatus 50 according to an embodiment of the present disclosure. The image forming apparatus 50 includes a platen 65 as a conveyor mechanism, the thermal-transfer sheet 30, a feed reel 61 and a take-up reel 62 as a travel mechanism, and a thermal-transfer head 51. The feed reel 61 feeds the thermal-transfer sheet 30, and the take-up reel 62 takes up the thermal-transfer sheet 30. At the same time, guide rollers 63 and 64 guide the thermal-transfer sheet 30 to a print position. The thermal-transfer head 51 is set between the guide rollers 63 and 64. By rotating a to-be-recorded medium 71 (hereinafter, referred to as receiver sheet 71), the platen 65 conveys the receiver sheet 71 to a print position corresponding to the thermal-transfer head 51. Papers that can be printed by thermal transfer, for example, printing papers, are used as the receiver sheet 71.

An example of the main portion in the structure will be described below.

The thermal-transfer sheet 30 wound on the feed reel 61 is taken up by the take-up reel 62 rotationally driven by a drive motor (not shown) while being supported by the guide rollers 63 and 64. A torque limiter (not shown), for example, is provided in the feed reel 61 and applies a back tension to the thermal-transfer sheet 30 by a constant torque. Further, in the take-up reel 62, a take-up detection encoder constituted of an optical sensor (not shown) is provided, for example.

As described above, as dyes corresponding to 1 page, for example, yellow, magenta, and cyan dyes are applied onto the thermal-transfer sheet 30 at a predetermined length. Further, on the thermal-transfer sheet 30, a page head mark and a winding diameter mark are applied at a head position of the dyes corresponding to 1 page, and a color identification mark for identifying a color is applied at a head position of each dye. The marks correspond to the sensor marks 35 described above (see FIG. 2).

As a result, in the image forming apparatus 50, the optical sensor 52 provided in the travel path of the thermal-transfer sheet 30 detects the page head marks and the color identification marks and carries out positioning of head portions of the dyes on the thermal-transfer sheet 30 based on the detection result.

Although not shown, the thermal-transfer head 51 is detachably attached to an end of a pressurization lever 53 rotatably held by a rotary shaft. The other end of the pressurization lever 53 is slidably attached to a comb plate via a link. As a result, the thermal-transfer head 51 is raised and lowered as the comb plate is rotationally driven by a head drive motor and positioned at an intermediate position at which the head can be moved longitudinally, an initial position that is above the intermediate position and is apart from the ribbon, and a bottom position that is below the intermediate position and at which the head comes into contact with the receiver sheet 71. As a result, the thermal-transfer head 51 moves to the initial position when the thermal-transfer sheet 30 is loaded and moves to the bottom position when the receiver sheet 71 is mounted on the platen 65.

The rise and lowering of the thermal-transfer head 51 is detected by the optical sensor provided in the vicinity of a notched portion of the comb plate, for example. The thermal-transfer head 51 is structured as an end face type and comes into contact with the receiver sheet 71 via the thermal-transfer sheet 30 across the entire width direction of the receiver sheet 71. As a result, as the receiver sheet 71 is moved in the direction indicated by the arrows, a desired image is printed across the entire surface of the receiver sheet 71.

Using the image forming apparatus 50 having the main portion as described above, a desired image is printed on the receiver sheet 71.

Next, a method of forming an image on a printing paper will be described.

As the thermal-transfer sheet 30 used in the image forming apparatus 50, the thermal-transfer sheet 30 in which the yellow ink layer 31Y, the magenta ink layer 31M, the cyan ink layer 31C, and the image protection layer 13 are repetitively arranged in order from the take-up side (take-up reel 62) to the feed side (feed reel 61) as described with reference to FIG. 2, for example, is used.

By using the image forming apparatus 50, images of yellow, magenta, and cyan color components are subjected to sublimational thermal transfer in the stated order with respect to a receiver layer (printing surface) side provided on the surface of the receiver sheet 71, and then the image protection layer 13 is subjected to sublimation thermal transfer with respect to the entire printing surface. As described above, in the image forming apparatus 50, the lamination process using the image protection layer 13 is carried out by the same process as the image formation of other color information.

In the color print, after an image is printed, the image protection layer 13 is formed on a surface of the image for enhancing a light resistance, a sebum resistance, and the like. Therefore, it is possible to suppress a color degradation of a printed image and enhance a preservation property. Further, an absolute value of a difference between the I/O values of the thermoplastic resins forming the untransferring release layer 12 and the image protection layer 13 is larger than 0.40 and smaller than 0.75. Therefore, in forming an image by thermal transfer, the image protection layer 13 can be easily peeled off from the untransferring release layer 12, and a quality of a color-printed print surface is not impaired. In addition, a sufficient resistance to an external force can be imparted, and inconveniences in terms of hanleability can be prevented from occurring.

Hereinafter, an experimental example of the thermal-transfer laminate film of the present disclosure will be described.

[Experimental Examples]

[Production of Thermal-Transfer Laminate Film]

Compositions of an untransferring release layer shown in Table 1 were applied onto a base film (polyester, "K604E4.5W" from Mitsubishi Plastics, Inc.) having a thickness of 4.5 μm such that dried thicknesses thereof become 1.0 μm and were dried (90°, 1 min), with the result that an untransferring release layer was formed.

Moreover, I and O values and I/O values as a ratio of those (hereinafter, also referred to as a value") were calculated for the thermoplastic resins included in the untransferring release layer. The results are shown in Table 1.

TABLE 1

| | Component name | I value | O value | I/O value | Composition amount (parts by mass) |
|---|---|---|---|---|---|
| Composition 1 | Polyvinyl alcohol (Poval PVA205 from KURARAY CO., LTD.) | 98.0 | 45.4 | 2.16 | 10 |
| | Water | — | — | — | 75 |
| | 2-propanol | — | — | — | 15 |

TABLE 1-continued

| | Component name | I value | O value | I/O value | Composition amount (parts by mass) |
|---|---|---|---|---|---|
| Composition 2 | Cellulose diacetate (L-20 from Daicel Corporation) | 314.0 | 216.0 | 1.45 | 10 |
| | Methylethyl ketone | — | — | — | 90 |
| Composition 3 | Polyvinyl acetal (BX-1 from SEKISUI CHEMICAL CO., LTD.) | 66.9 | 86.6 | 0.77 | 10 |
| | Methylethyl ketone | — | — | — | 45 |
| | Toluene | — | — | — | 45 |
| Composition 4 | Polyvinyl butyral (BL-2 from SEKISUI CHEMICAL CO., LTD.) | 69.6 | 107.2 | 0.65 | 10 |
| | Methylethyl ketone | — | — | — | 45 |
| | Toluene | — | — | — | 45 |
| Composition 5 | Polyvinyl butyral (BL-S from SEKISUI CHEMICAL CO., LTD.) | 62.1 | 123.7 | 0.50 | 10 |
| | Methylethyl ketone | — | — | — | 45 |
| | Toluene | — | — | — | 45 |

Here, as an example of a method of calculating I and O values, an example of polystyrene (G100C from TOYO STYRENE CO., LTD.) used in Composition 8 shown in Table 3 is shown in Table 2.

In calculating an I/O value of a polymer, first, considering a structural formula of a monomer as a polymer structural unit, elements such as a functional group that are included in the monomer are digitalized based on "New Edition of Essentials of Organic Conceptual Diagram" (Yoshio Koda, Shiro Sato, and Yoshio Honma, SANKYO PUBLISHING Co., Ltd., 2008). At this time, it should be noted that even the functional group including a monomer like a double bond included in styrene is intrinsically a functional group that is eliminated by a polymerization reaction.

TABLE 2

| Element | Number | I value | O value |
|---|---|---|---|
| C (all carbon) | 8 | 0 | 160 |
| Benzene nucleus (monocyclic) | 1 | 15 | 0 |
| Double bond | 0 (none since) | 0 | 0 |
| Sum of I and O values of polystyrene | | 15 | 160 |

In this example, the I value is calculated to be 15, the O value is calculated to be 160, and the I/O value is calculated to be 0.09. The I, O, and I/O values of Compositions 1 to 7 shown in Tables 1 and 3 are calculated by the same method as that described above.

Subsequently, each of Compositions 6 to 8 for forming an image protection layer shown in Table 3 was applied onto the untransferring release layer described above such that a dried thickness thereof becomes 0.8 μm and was dried (90°, 1 min), with the result that an image protection layer was formed. Further, I and O values were calculated for the thermoplastic resin used for the image protection layer by the same method, and an I/O value (hereinafter, also referred to as b value) as a ratio of those values was also calculated. The results are shown in Table 3.

TABLE 3

| | Component name | I value | O value | I/O value | Composition amount (parts by mass) |
|---|---|---|---|---|---|
| Composition 6 | Polymethyl methacrylate (MH-101-5 from FUJIKURAKASEI CO., LTD.) | 85.0 | 100.0 | 0.85 | 10 |
| | Methylethyl ketone | — | — | — | 45 |
| | Toluene | — | — | — | 45 |
| Composition 7 | Polymethyl methacrylate (MH-105-4 from FUJIKURAKASEI CO., LTD.) | 85.0 | 120.0 | 0.71 | 10 |
| | Methylethyl ketone | — | — | — | 45 |
| | Toluene | — | — | — | 45 |
| Composition 8 | Polystyrene (G100C from TOYO STYRENE CO., LTD.) | 15.0 | 160.0 | 0.09 | 10 |
| | Toluene | — | — | — | 90 |

Subsequently, a composition for forming an adhesive layer shown in Table 4 was applied onto the image protection layer such that a dried thickness thereof becomes 0.8 μm and was dried (100°, 1 min), with the result that an adhesive layer was formed.

TABLE 4

| | Component name | Composition amount (parts by mass) |
|---|---|---|
| Composition of adhesive layer | Poly-n-butyl methacrylate (MS-2003-1 from FUJIKURAKASEI CO., LTD.) | 10 |
| | Methylethyl ketone | 45 |
| | Toluene | 45 |

Subsequently, a composition for forming a heat resistant slipping layer shown in Table 5 was applied onto the surface of the base film on the other side of the side on which the untransferring release layer, the image protection layer, and the adhesive layer are formed such that a dried thickness thereof becomes 0.4 μm and was dried (100°, 1 min), with the result that a heat resistant slipping layer was formed.

TABLE 5

| | Component name | Composition amount (parts by mass) |
|---|---|---|
| Composition of heat resistant slipping layer | Polyvinyl butyral (S-LEC BH-3 from Shimizu Chemical Corporation) | 10 |
| | Isocyanate (CORONATE L FROM NIPPON POLYURETHANE INDUSTRY CO., LTD.) | 3 |
| | Phosphate ester (RL-210 from TOHO Chemical Industry Co., LTD.) | 2 |
| | Silicon filler (TOSPEARL from Momentive Performance Materials Inc.) | 0.2 |
| | Methylethyl ketone | 90 |
| | Toluene | 90 |

The thermal-transfer laminate films were thus produced and used as Experimental Examples 1 to 15. Table 6 shows an a value, a b value, and an absolute value of a difference between the a and b values for each composition in the experimental examples. In Experimental Examples 1 to 15, the untransferring release layers formed of Compositions 1 to 5 and the image protection layers formed of Compositions 6 to 8 are combined. Specifically, Compositions 6 to 8 are applied onto Composition 1 in Experimental Examples 1 to 3, Compositions 6 to 8 are applied onto Composition 2 in Experimental Examples 4 to 6, Compositions 6 to 8 are applied onto Composition 3 in Experimental Examples 7 to 9, Compositions 6 to 8 are applied onto Composition 4 in Experimental Examples 10 to 12, and Compositions 6 to 8 are applied onto Composition 5 in Experimental Examples 13 to 15.

TABLE 6

| | Untransferring release layer | | Image protection layer | | Absolute value of |
|---|---|---|---|---|---|
| | Composition | I/O value (a value) | Composition | I/O value (b value) | difference between I/O values (\|a − b\|) |
| Experimental Example 1 | Composition 1 | 2.16 | Composition 6 | 0.85 | 1.31 |
| Experimental Example 2 | | | Composition 7 | 0.71 | 1.45 |
| Experimental Example 3 | | | Composition 8 | 0.09 | 2.07 |
| Experimental Example 4 | Composition 2 | 1.45 | Composition 6 | 0.85 | 0.60 |
| Experimental Example 5 | | | Composition 7 | 0.71 | 0.74 |
| Experimental Example 6 | | | Composition 8 | 0.09 | 1.36 |
| Experimental Example 7 | Composition 3 | 0.77 | Composition 6 | 0.85 | 0.08 |
| Experimental Example 8 | | | Composition 7 | 0.71 | 0.06 |
| Experimental Example 9 | | | Composition 8 | 0.09 | 0.68 |
| Experimental Example 10 | Composition 4 | 0.65 | Composition 6 | 0.85 | 0.20 |
| Experimental Example 11 | | | Composition 7 | 0.71 | 0.06 |

TABLE 6-continued

| | Untransferring release layer | | Image protection layer | | Absolute value of |
|---|---|---|---|---|---|
| | Com-position | I/O value (a value) | Composition | I/O value (b value) | difference between I/O values (\|a − b\|) |
| Experimental Example 12 | | | Composition 8 | 0.09 | 0.56 |
| Experimental Example 13 | Com-position 5 | 0.50 | Composition 6 | 0.85 | 0.35 |
| Experimental Example 14 | | | Composition 7 | 0.71 | 0.21 |
| Experimental Example 15 | | | Composition 8 | 0.09 | 0.41 |

[Evaluation of Thermal-Transfer Laminate Film]

Next, for evaluating the produced thermal-transfer laminate films, a detachability evaluation test and a cellophane tape peeling test were carried out.

In the detachability evaluation test, solid white printing was performed on a pure printing paper for "UP-DR150" (2UPC-R154) from Sony Corporation by a "UP-DR150" printer from Sony Corporation, and an evaluation was made on whether peeling easily occurs between the untransferring release layer and the image protection layer formed on the base film and whether the image protection layer is thus transferred onto the printing paper.

Regarding an evaluation criterion for the detachability evaluation test, a case where a quality of a surface of a formed image is not impaired and peeling occurs easily was evaluated as "○", and a case where, for example, an ink ribbon sticks to a printing paper during printing and peeling does not occur favorably was evaluated as "x".

In the cellophane tape peeling test, a cellophane tape was bonded tightly and uniformly onto the top surface of the thermal-transfer laminate film, that is, the surface of the adhesive layer and was then held for about 1 minute to be peeled off swiftly after that. Accordingly, whether peeling has occurred between the untransferring release layer and the image protection layer when an external force is applied to the top surface of the thermal-transfer laminate film, that is, the surface of the adhesive layer was evaluated.

The evaluation criteria for the cellophane tape peeling test are as follows.

●: Image protection layer was not peeled off at all.

○: Image protection layer was partially peeled off.

Δ: Image protection layer was peeled off although there was resistance during peeling.

x: Image protection layer was entirely peeled off with almost no resistance during peeling.

Table 7 shows results of the detachability evaluation test. In Experimental Examples 1 to 6, 9, 12, and 15 in which the absolute value of a difference between the a and b values is larger than 0.40, it was confirmed that peeling occurs easily and a quality of a surface of the obtained image is not impaired, thus being evaluated as "○". On the other hand, in Experimental Examples 7, 8, 10, 11, 13, and 14 in which the absolute value of a difference between the a and b values is smaller than 0.40, it was confirmed that peeling did not occur favorably and the ink ribbon adhered onto the printing paper during a print process of the printer, thus being evaluated as "x".

TABLE 7

| | Absolute value of difference between I/O values (\|a − b\|) | Evaluation on detachability |
|---|---|---|
| Experimental Example 1 | 1.31 | ○ |
| Experimental Example 2 | 1.45 | ○ |
| Experimental Example 3 | 2.07 | ○ |
| Experimental Example 4 | 0.60 | ○ |
| Experimental Example 5 | 0.74 | ○ |
| Experimental Example 6 | 1.36 | ○ |
| Experimental Example 7 | 0.08 | x |
| Experimental Example 8 | 0.06 | x |
| Experimental Example 9 | 0.68 | ○ |
| Experimental Example 10 | 0.20 | x |
| Experimental Example 11 | 0.06 | x |
| Experimental Example 12 | 0.56 | ○ |
| Experimental Example 13 | 0.35 | x |
| Experimental Example 14 | 0.21 | x |
| Experimental Example 15 | 0.41 | ○ |

Table 8 shows results of the cellophane tape peeling test. In Experimental Examples 7, 8, 10, 11, 13, and 14 in which the absolute value of a difference between the a and b values is smaller than 0.40, the image protection layer is not peeled off at all thus being evaluated as "●" in the cellophane tape peeling test. In Experimental Examples 4, 5, 9, 12, and 15 in which the absolute value of a difference between the a and b values is larger than 0.40 and smaller than 0.75, the image protection layer is partially peeled off, thus being evaluated as "○". Specifically, when the absolute value of a difference between the a and b values is smaller than 0.75, it was confirmed that peeling does not occur easily at the interface of the layers by tape peeling, and handleability is excellent.

TABLE 8

| | Absolute value of difference between I/O values (\|a − b\|) | Cellophane tape peeling test | Handleability evaluation |
|---|---|---|---|
| Experimental Example 1 | 1.31 | x | x |
| Experimental Example 2 | 1.45 | x | x |
| Experimental Example 3 | 2.07 | x | x |
| Experimental Example 4 | 0.60 | ○ | ○ |
| Experimental Example 5 | 0.74 | ○ | ○ |
| Experimental Example 6 | 1.36 | x | x |
| Experimental Example 7 | 0.08 | ● | ○ |

TABLE 8-continued

| | Absolute value of difference between I/O values (\|a − b\|) | Cellophane tape peeling test | Handleability evaluation |
|---|---|---|---|
| Experimental Example 8 | 0.06 | ● | ○ |
| Experimental Example 9 | 0.68 | ○ | ○ |
| Experimental Example 10 | 0.20 | ● | ○ |
| Experimental Example 11 | 0.06 | ● | ○ |
| Experimental Example 12 | 0.56 | ○ | ○ |
| Experimental Example 13 | 0.35 | ● | ○ |
| Experimental Example 14 | 0.21 | ● | ○ |
| Experimental Example 15 | 0.41 | ○ | ○ |

On the other hand, in Experimental Examples 1 to 3 and 6 in which the absolute value of a difference between the a and b values is larger than 0.75, the adhesive force between the untransferring release layer and the image protection layer was weak and the image protection layer was peeled off in the cellophane tape peeling test, thus being evaluated as "x".

It was indicated by the results above that when the absolute value of a difference between the a and b values is larger than 0.40, the detachability between the untransferring release layer and the image protection layer is high and a quality of the obtained image is not impaired. In addition, when the absolute value of a difference between the a and b values is larger than 0.40 and smaller than 0.75, it was confirmed that the detachability between the untransferring release layer and the image protection layer is high, there is a sufficient resistance to an external force that may occur in handling, and an excellent handleability can be obtained. Consequently, it was confirmed that, since there is a high detachability between the untransferring release layer and the image protection layer when thermal transfer is performed using the thermal-transfer laminate film according to the present disclosure, a quality of the image is not impaired, and an excellent handleability can be obtained.

The embodiments of the present disclosure have been described heretofore, but the present disclosure is not limited to the embodiments above and can be variously modified without departing from the gist of the present disclosure.

It should be noted that the present disclosure can also take the following structure.

(1) A thermal-transfer laminate film, including:

a base film;

an untransferring release layer that is provided on the base film and includes a first thermoplastic resin having a first I/O value; and an image protection layer that is provided on the untransferring release layer and includes a second thermoplastic resin having a second I/O value, an absolute value of a difference between the first I/O value and the second I/O value being larger than 0.40.

(2) The thermal-transfer laminate film according to (1), further including an adhesive layer provided on the image protection layer.

(3) The thermal-transfer laminate film according to (1) or (2), in which the absolute value of the difference between the first I/O value and the second I/O value is smaller than 0.75.

The present disclosure contains subject matter related to that disclosed in Japanese Priority Patent Application JP 2011-068387 filed in the Japan Patent Office on Mar. 25, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal-transfer laminate film, comprising:

a base film;

an untransferring release layer that is provided on the base film and includes a first thermoplastic resin having a first I/O value; and an image protection layer that is provided on the untransferring release layer and includes a second thermoplastic resin having a second I/O value, an absolute value of a difference between the first I/O value and the second I/O value being larger than 0.40.

2. The thermal-transfer laminate film according to claim 1, further comprising an adhesive layer provided on the image protection layer.

3. The thermal-transfer laminate film according to claim 1, wherein the absolute value of the difference between the first I/O value and the second I/O value is smaller than 0.75.

4. A thermal-transfer sheet, comprising:

a base film;

an untransferring release layer that is provided on the base film and includes a first thermoplastic resin having a first I/O value;

an image protection layer that is provided on the untransferring release layer and includes a second thermoplastic resin having a second I/O value, an absolute value of a difference between the first I/O value and the second I/O value being larger than 0.40 and smaller than 0.75; and an ink layer that is provided on the base film.

5. An image forming apparatus, comprising:

a conveyor mechanism configured to convey a to-be-recorded medium in a predetermined direction;

a thermal-transfer sheet including an untransferring release layer that includes a first thermoplastic resin having a first I/O value, an image protection layer that includes a second thermoplastic resin having a second I/O value, an absolute value of a difference between the first I/O value and the second I/O value being larger than 0.40 and smaller than 0.75, and an ink layer that is thermally transferred onto a surface of the to-be-recorded medium to form an image;

a travel mechanism configured to cause the thermal-transfer sheet to travel; and a thermal-transfer head configured to cause one of the ink layer and the image protection layer of the thermal-transfer sheet to be thermally transferred onto the surface of the to-be-recorded medium.

* * * * *